US006538555B2

(12) United States Patent
Fliegner

(10) Patent No.: US 6,538,555 B2
(45) Date of Patent: Mar. 25, 2003

(54) THROTTLE VALVE HAVING POTENTIOMETER WITH SUPPORTING PLATE

(75) Inventor: Jörg Fliegner, Roshausen (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/874,727

(22) Filed: Jun. 4, 2001

(65) Prior Publication Data

US 2002/0050920 A1 May 2, 2002

Related U.S. Application Data

(63) Continuation-in-part of application No. 09/423,707, filed on Feb. 18, 2000.

(30) Foreign Application Priority Data

Mar. 13, 1998 (DE) ..... 198 10 844

(51) Int. Cl.[7] ..... H01C 10/32

(52) U.S. Cl. ..... 338/118; 338/162; 338/180; 338/197; 29/610.1

(58) Field of Search ..... 338/197, 162, 338/118, 180; 29/610.1, 834

(56) References Cited

U.S. PATENT DOCUMENTS

| | | | | | |
|---|---|---|---|---|---|
| 2,616,643 | A | * | 11/1952 | Budd | 248/27.1 |
| 2,777,926 | A | * | 1/1957 | Bourns | 338/180 |
| 2,866,054 | A | * | 12/1958 | Purdy | 338/174 |
| 2,880,296 | A | * | 3/1959 | Berkelhamer | 338/275 |
| 2,960,754 | A | * | 11/1960 | Coda et al. | 338/197 |
| 3,298,641 | A | * | 1/1967 | Puerner | 338/197 |
| 3,500,282 | A | * | 3/1970 | Slagg | 338/197 |
| 3,531,076 | A | * | 9/1970 | Bang | 338/197 |
| D228,070 | S | * | 8/1973 | Oka et al. | 338/197 |
| 4,427,316 | A | | 1/1984 | Moore et al. | |
| 4,588,854 | A | * | 5/1986 | Bailey et al. | 338/197 |
| 4,750,090 | A | * | 6/1988 | Abe | 338/197 |

FOREIGN PATENT DOCUMENTS

| | | | | |
|---|---|---|---|---|
| DE | 3428006 | | 1/1986 | |
| DE | 3532646 | | 3/1987 | |
| DE | 29705954 | | 5/1997 | |
| DE | 29705954 | | 7/1997 | |
| DE | 19627726 | | 1/1998 | |
| EP | 0168682 | | 1/1986 | |
| EP | 0645786 | | 3/1995 | |
| GB | 1000160 | * | 8/1965 | 338/197 |
| GB | 2229864 | | 10/1990 | |

* cited by examiner

*Primary Examiner*—Karl D. Easthom
(74) *Attorney, Agent, or Firm*—Martin A. Farber

(57) ABSTRACT

The invention relates to a throttle valve comprising a potentiometer with a supporting plate (1) the supporting plate (1) to be mounted on a substrate wherein the supporting plate (1) has an upper side (18) on which the resistance tracks (3, 4), wiper tracks (5, 6) and the conductor tracks (7) are applied on an underside (19) with spacers.

4 Claims, 5 Drawing Sheets

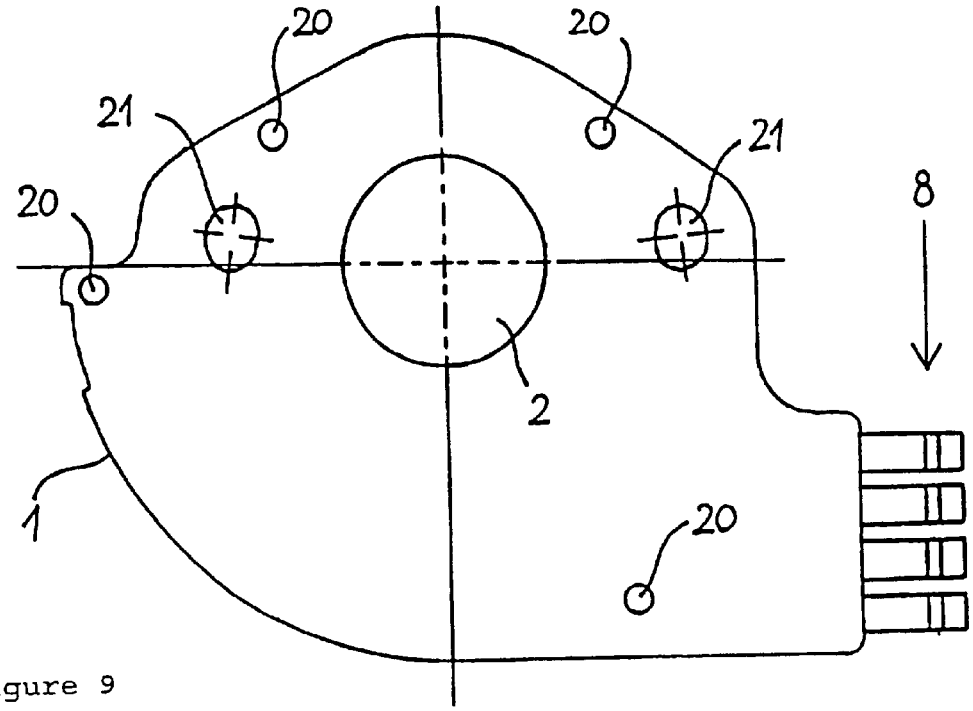
Figure 9
Figure 10
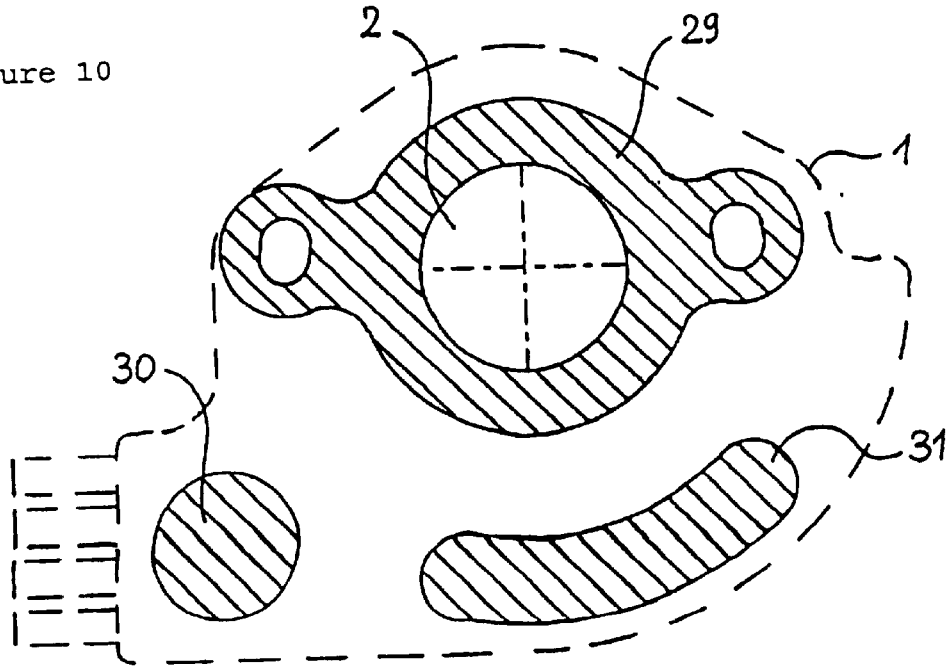

THROTTLE VALVE HAVING POTENTIOMETER WITH SUPPORTING PLATE

RELATED APPLICATION

This is a continuation in part of my pending application Ser. No. 09/423,707 filed Feb. 18, 2000, the entire contents of which are hereby incorporated by reference herein.

FIELD AND BACKGROUND OF THE INVENTION

The invention relates to a throttle valve having a supporting plate for a device for registering the position of a moving part, especially a potentiometer.

Such a supporting plate is described in DE 34 28 006 C2. This discloses an electric module which carries a printed circuit, this module having a supporting part shaped like a table mountain, which is provided on its surface with elevations. These elevations, which may also be of elongate design, are used, in interplay with an adjusting pin on the supporting part, for the precise alignment of the printed circuit, the printed circuit having a hole to accommodate the adjusting pin and being fixed in its desired position by means of an adhesive compound and resting in a precisely defined way on the elevations. The table-mountain-shaped supporting part has an extremely complex configuration and therefore necessitates complicated production.

Furthermore, it is necessary to provide the printed circuits for the installation of the module, no statements relating to this provision being made in DE 34 28 006 C2.

SUMMARY OF THE INVENTION

The invention is therefore based on the object of configuring a supporting plate in a throttle valve as simply as possible, specifically in such a way that not only is simple installation provided but, moreover, stock-keeping is also improved. The supporting plate forms a part of a potentiometer of the throttle valve, and has an upper side on which are located resistance tracks, wiper tracks, and conductor tracks of the potentiometer. The supporting plate has an underside on which are located spacers for positioning the supporting plate on a housing of the throttle valve.

The arrangement according to the invention of spacers on one side of the supporting plate has, on the one hand, the advantage that the bearing surface for the supporting plate can be kept continuously flat to the greatest possible extent, which is advantageous, in particular, in a complex shaped supporting part. The spacers thus define a precise distance between the underside of the supporting plate and the surface of the supporting part, so that simple and precise installation is possible without further adjustment tools or apparatus being necessary. Furthermore, the invention provides the advantage that, by means of the spacers, the supporting plates can be stacked one above another in order to provide them for further processing. This is advantageous precisely in the case of mass production of registration devices or the like, since, for example on a production line, a large number of such supporting plates have to be provided one after another for continuing installation. On the one hand, it is possible for these supporting plates, following their production, to be stacked readily one above another by means of the spacers which are already present, while the removal of these supporting plates from a stack is also readily possible. In particular, automated stacking on one another or removal from the stack is possible. This avoids the supporting plates having to be handled manually, in order thus to avoid contamination (for example by traces of grease). The handling of the supporting plates can be carried out, for example, by a gripper by means of vacuum. Such spacers are particularly advantageous if sensitive coatings are applied to the other side, that is to say facing away from the side on which the spacers are arranged. Likewise, the invention dispenses with individual spacers, which would have to be placed between the individual supporting plates which are stacked on one another, during transport and during stock-keeping. By this means, in particular in large-scale mass production, the costs for stock-keeping are reduced quite significantly.

In a development of the invention, the spacers can be fastened to the supporting plate as individual studs. As already outlined, coatings, such as conductor tracks, wiper tracks or the like, or else electronic components can be arranged on one side of the supporting plate. After the supporting plate per se has been produced, individual studs are fastened to the other side, this fastening being, for example, injection-molding the individual studs on, bonding them on or the like. This has the advantage that, because of the fastening of the individual studs, all the studs or some of them can consist of a material different from that of the supporting plate. The material is advantageously chosen depending on the material of the supporting plate, so that on the one hand good fastening of the individual studs to the supporting plate is ensured. On the other hand, the material may be chosen from the point of view that the material of the individual studs is matched to the material of the surface on which the studs subsequently rest with the supporting plate. One example which may be mentioned here is that the studs consist of an elastically deformable material and can perform a damping function.

In a development of the invention, the spacers can be produced as individual studs together with the supporting plate. During the production of supporting plate and studs, this advantageously leads to a single production operation, so that the studs are already present at the same time as the production of the supporting plate.

Particularly advantageous is the production of the supporting plate in an injection-molding process, the supporting plate with the individual studs consisting of plastic. A supporting plate made of plastic has the advantage that this constitutes an electrical insulator if conductor tracks, wiper tracks and the like are arranged on the surface of the supporting plate and one or more voltages are applied. If a number of supporting plates are then stacked one above another and one surface of the supporting plate has already been coated with these wiper or conductor tracks, the result is that the damage to the surface of the wiper or conductor tracks by the supporting plate located above is effectively avoided, since the latter in turn rests with its own studs on those regions of the supporting plate located below in which there are no wiper or conductor tracks.

In a development of the invention, the spacers are designed as bearing surfaces. Alternatively or in addition to the spacers designed as studs, bearing surfaces are provided which are of greater area than the studs and thus distribute the bearing forces over a greater area. This is particularly advantageous when fastening means (for example screws or the like) are provided in the vicinity of such a bearing surface, by which means the supporting plate is fixed to the surface resting on it. Thus, in a development of the invention, the bearing surfaces are arranged in the area of fastening holes, good contact and reliable fixing of the supporting plate in its position being achieved on account of the greatest possible concentric arrangement around the fastening hole. In this case, adhesive bonding of the supporting plate to the bearing surface can be dispensed with. As an alternative to this, the studs and/or the bearing surfaces can be used for the purpose of adhesively bonding the supporting plate to its substrate via these bearing surfaces. By comparison with adhesively bonding the supporting plate to the substrate over the entire area, this saves adhesive to a considerable extent.

In a development of the invention, a number of supporting plates can be provided stacked one above another in a magazine for further processing. It is thus possible for supporting plates, after the individual studs have been fastened to them, or after the one-piece supporting plate with integrally molded studs or bearing surfaces has been produced, to be put into the magazine and stacked one above another. This has the advantage that stock-keeping and transport costs are reduced, since more supporting plates can be accommodated in the same space by comparison with the conventional deep-drawn pallets, in which the supporting plates are arranged alongside one another. Of course, it is also conceivable to line up a number of magazines in a row or one magazine with a number of compartments for supporting plates to be stacked one above another. Stacking the supporting plates one above another in the magazine has, moreover, the advantage that, for the purpose of the further processing or for the final installation of a supporting plate, the latter can be picked up automatically by an appropriately designed pick-up apparatus. It is thus possible for the further processing operation on a supporting plate (for example coating with conductor and/or wiper tracks) or, respectively, the final installation to be automated. Manual handling of the supporting plates is thus avoided, so that the supporting plates can no longer be contaminated and complicated cleaning operations before coating can be dispensed with. Furthermore, an empty magazine of an installation apparatus can simply be removed and a full magazine can be inserted in turn, it also being possible for this removal operation and the subsequent operation of inserting a filled magazine to be automated.

In a development of the invention, the magazine has webs or the like for fixing the supporting plates stacked one above another in position. Thus, on the one hand, any movement of the supporting plate within the magazine is avoided; on the other hand, this positional fixing during the removal of a supporting plate from the magazine makes any adjustment of position for the subsequent further processing operation unnecessary. Alternatively or in addition to the webs for positional fixing, outer contour points on the supporting plate, which come to rest on internal areas of the magazine, can be used for the positional fixing.

In a development of the invention, a mandrel or the like is provided, which accommodates and moves the supporting plates stacked one above another in the stacking direction, so that said supporting plates can be removed from the magazine one after another for further processing. If the supporting plate has a hole, a recess or the like or a number of these, these can be used in that the supporting plates are guided over the mandrel via this hole or the like and, for example, come to rest on the bottom of the magazine. By moving up the movable bottom of the magazine or only of the mandrel, which carries with it the supporting plate deposited first in the magazine, one supporting plate after the other can be provided for further processing by being moved up continuously or intermittently.

In a development of the invention, it is advantageously used in a potentiometer, either for registering the position of the throttle valve or for registering the position of the gas pedal for controlling the output of an internal combustion engine. The configuration of such a potentiometer is shown later in the figures, the invention not being restricted to such a potentiometer but also being used, for example, in other registration methods, for example inductive, magnetic, capacitive registration or the like.

BRIEF DESCRIPTION OF THE DRAWINGS

An exemplary embodiment, to which the invention is not restricted, however, is described in the following text and explained using the figures of the drawings, in which FIG. 9 shows the underside of a supporting plate, FIG. 10 shows bearing surfaces for the supporting plate.

DETAILED DESCRIPTION OF THE PREFERRED EMBODIMENT

Figure 1:
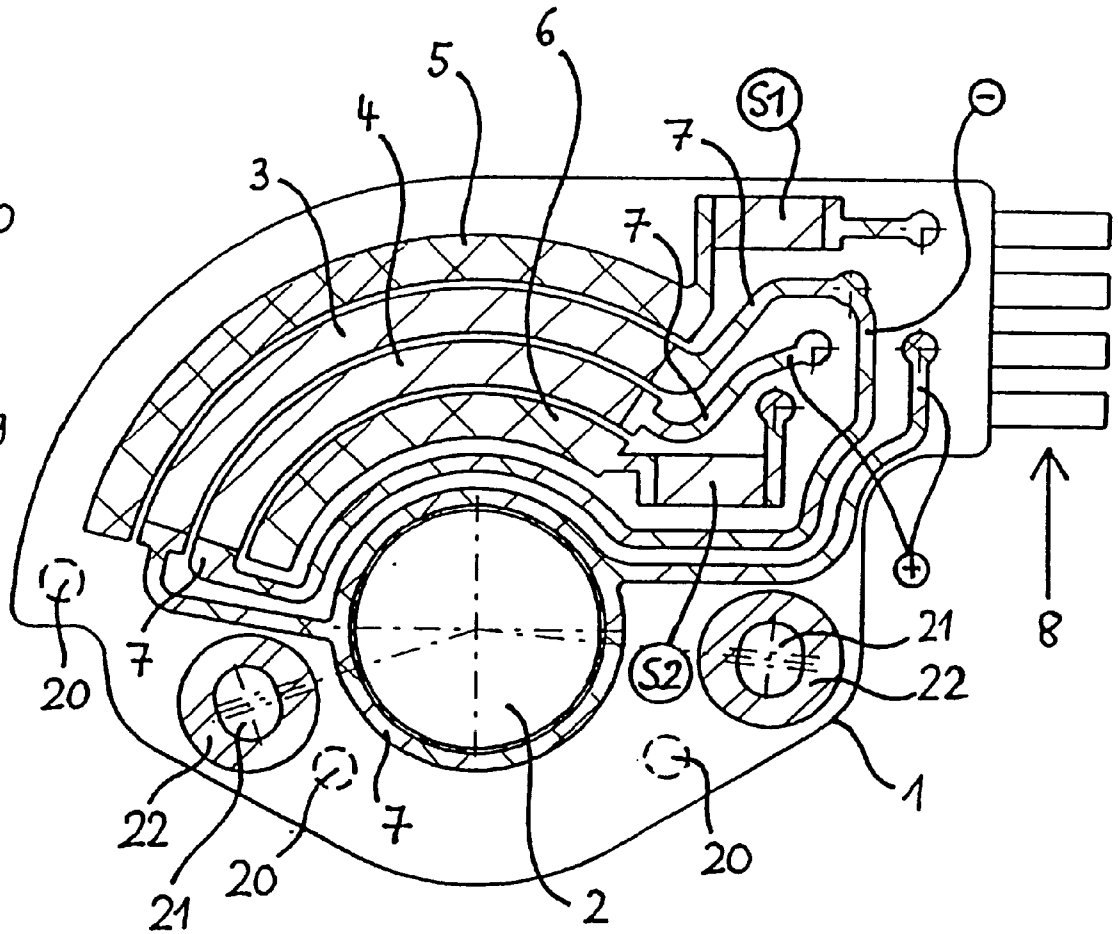
FIG. 1 shows a plan view of a supporting plate.

FIG. 1 shows, in plan view, a position-registering device of a throttle valve. A supporting plate 1 (printed circuit board) has a hole 2, for example for a shaft of the throttle valve to be lead through for a common drive. The reference symbols 3 and 4 designate resistance tracks, and the reference symbols 5 and 6 designate wiper tracks. The arrangement of resistance tracks 3, 4 and wiper tracks 5, 6 shown in FIG. 1 is exemplary, it also being possible, for example for the arrangement of the resistance tracks and the wiper tracks to be exchanged. Via further conductor tracks 7, the resistance tracks 3, 4 and the wiper tracks 5, 6 are led, depending on the constructional designs of the supporting plate 1 (for example, also taking into account holes which are used for fastening the support plate 1), into an area in which there is a connection (for example contact finger 8). It is also conceivable for connecting lines to be soldered onto the conductor tracks 7, or fastened in any other way, instead of a plug. A different potential (plus or minus) is present at the end of each resistance track 3, 4, an identical or opposite potential being present at the two adjacent ends of each resistance track 3, 4. The slopes (output signals) of the resistance tracks 3, 4 thus run in opposite directions or in the same direction as they are swept over in the same direction. The signals from the resistance tracks 3, 4 are transmitted to the wiper tracks 5 and, respectively 6 via components of a moving pick-off (see FIGS. 3 to 6), so that in each case two full-value signals S1 and S2 are available on these wiper tracks 5, 6, and can likewise be picked off via the contact fingers 8.

Figure 2:
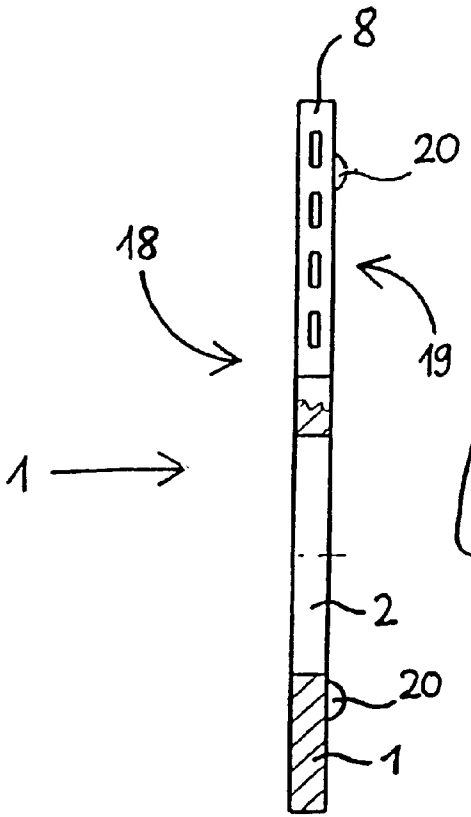
FIG. 2 shows a section through a supporting plate.

FIG. 2 shows a section through the position-registering device, the flat construction being illustrated, which is advantageous, in particular, when the space available is tight.

Figure 3:
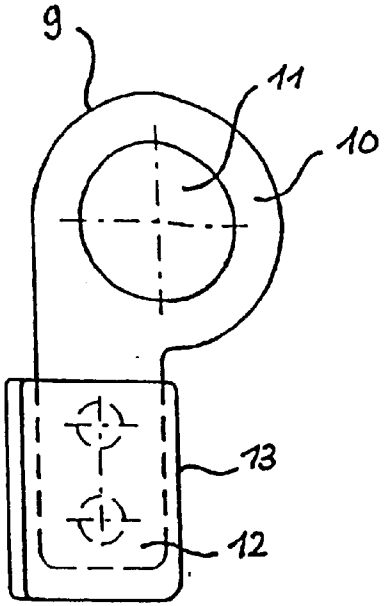

FIGS. 3 to 6 show illustrations of a position pick-up, FIG. 3 illustrating a moving pick-off 9 which, at one end, has a round section 10 with which the moving pick-off 9 is arranged on a shaft 11 (for example a throttle-valve shaft) so that it rotates with it. Provided at the other end is an elongate section 12, which has an intermediate carrier 13. The intermediate carrier 13 may be arranged firmly on the elongate section 12, designed in one piece with the elongate section 12 or, for the purpose of the adjustment, be connected to the elongate section 12 such that it can move (for example by means of a screw fixing). It is also conceivable, following adjustment to bond the intermediate carrier 13 to the elongate section 12 adhesively or the like.

Figure 4:
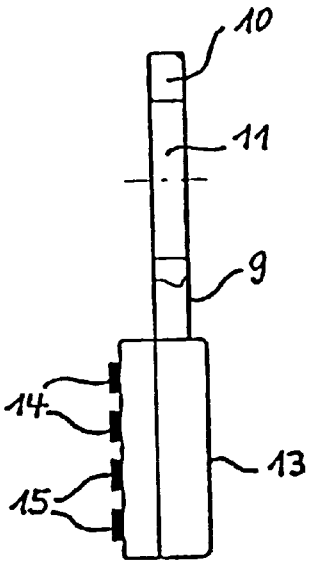

FIG. 4 shows that the intermediate carrier 13 has, in each case, a pair of wiper fingers 14 and 15, in each case one pair of wiper fingers bridging across a resistance track and a wiper track (3, 5 and 4, 6).

Figure 5:
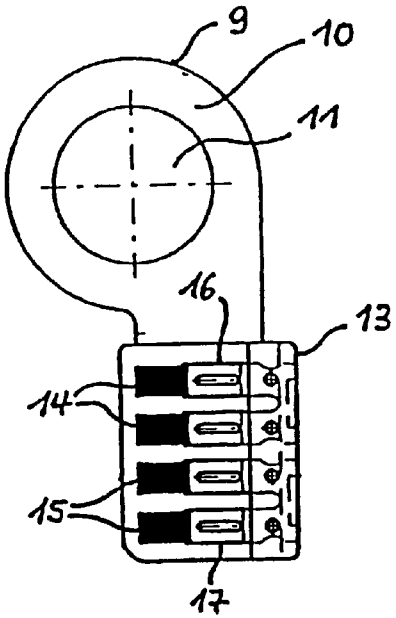

FIG. 5 shows the underside of the intermediate carrier 13, where it can be seen that the pairs of wiper fingers 14 and 15 are connected to one another via wiper-finger carriers 16 and 17 and, by means of these wiper-finger carriers 16, are arranged on the intermediate carrier 13 (for example by riveting) so that they are electrically insulated with respect to the intermediate carrier 13 and the moving pick-off 9. The pairs of wiper fingers 14 and 15 are arranged one behind another in a line, starting from the point of rotation about the shaft 11 (or the hole 2).

Figure 6:
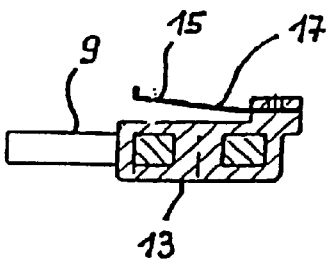
FIGS. 3 to 6 show configurations of a moving pick-off.

FIG. 6 shows a section through the intermediate carrier 13, it being possible to see that the pairs of wiper fingers 14 and 15, including their wiper-finger carriers 16 and 17, are arranged bent away at an angle from the surface of the intermediate carrier 13. The purpose of this is that the pairs of wiper fingers 14 and 15, after the moving pick-off 9 has been installed on the shaft 11 and then parallel to the supporting plate 1, press with a spring action on the resistance tracks 3, 4 and the wiper tracks 5, 6. With regard to the configuration of the moving pick-off 9, as shown in FIGS. 3 to 6, reference is made to the German Utility Model G 91 14 407.8, the configuration of such a moving pick-off being described in FIGS. 1 and 2, in addition to an associated figure description of the German Utility Model. In this case, the constructional design of the moving pick-off is not restricted to this embodiment, instead it is possible to use all those embodiments which fulfill the same function. Furthermore, the invention can, of course, also refer to configurations in which the resistance tracks and the wiper tracks are designed as straight lines, and the moving pick-off executes a linear movement instead of a rotational movement.

The supporting plate 1 shown in FIGS. 1 and 2 has an upper side 18 on which, for example, the resistance tracks 3, 4 and wiper tracks 5, 6 and the conductor tracks 7 have been applied. On an underside 19, the supporting plate 1 is provided with the studs 20 designed as spacers. The height of these studs 20 depends on the geometric conditions. If both the underside 19 of the supporting plate 1 and the bearing surface for the supporting plate 1, which is not illustrated, are to a large extent level, this height of the studs 20 can be kept low (for example <1 mm). If, however, electronic components or other elevations are also present on the underside 19 of the supporting plate 1 or, respectively, on the surface of the bearing surface, the height of the studs 20 should be selected to be correspondingly greater.

In addition, FIG. 1 also shows that the studs 20 are distributed to such an extent over the underside 19 of the supporting plate 1 that stable contact is achieved. In addition to the studs 20 drawn dashed in FIG. 1, provision may be made, for example, for a further stud underneath the area which is designated by S1. Alternatively or in addition to this, the spacers are arranged in the area of fastening holes 21, the position of the supporting plate 1 being fixed by inserting a screw through the fastening hole 21 into a corresponding receiving hole in the supporting part located underneath. It is also conceivable for a threaded piece to project from this supporting part, the supporting plate 1 then being placed onto the threaded piece via the fastening holes 21 and fixed in position with a screwed-on nut. FIG. 1 shows bearing surfaces 22 which are arranged concentrically around the fastening holes 21. Alternatively or in addition to this, further bearing surfaces may be provided, which may be circular, rectangular, square, arcuate, ellipsoidal or the like. In order to achieve the highest possible stability, in the case of a design of the supporting plate 1 as is illustrated in FIG. 1, in addition to the bearing surfaces 22, a largely circular bearing surface is arranged in the area of the contact fingers 8, and an arcuate further bearing surface is arranged in a subarea of the wiper track 5 (or with a width extending somewhat beyond this).

Figure 7:
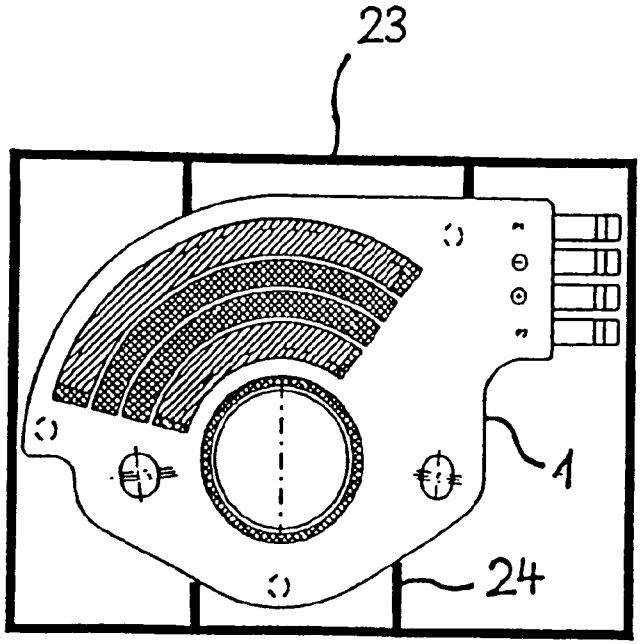

FIG. 7 shows a magazine 23 to accommodate a number of supporting plates 1 stacked one above another, this magazine 23 having a number of webs 24, which have such an extent that the supporting plates 1 stacked one above another are fixed in position by means of these webs 24. FIG. 7 shows a plan view of the magazine 23, it being possible to see that the upper side 18 projects from the FIG. 7.

Figure 8:
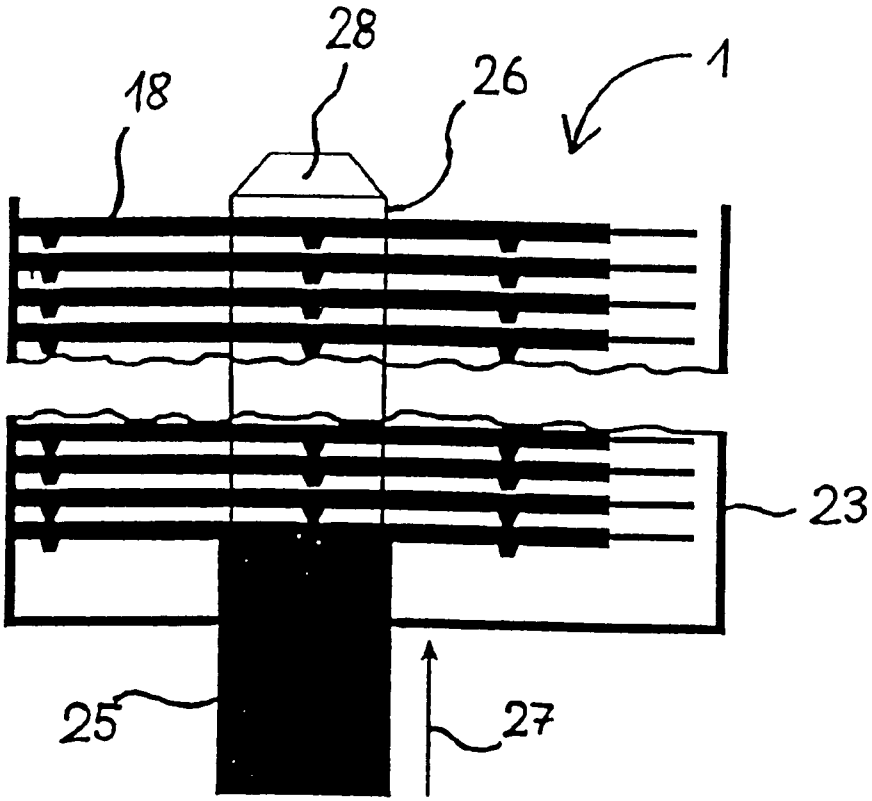
FIGS. 7 and 8 show configurations of a magazine for stacking supporting plates.

FIG. 8 shows a section through the magazine 23, it being possible to see that a large number of supporting plates 1 are stacked one above another, this being possible without any damage to the surfaces of the individual supporting plates 1 (in particular their coated surfaces), as a result of the spacers according to the invention. A sleeve 25 may pass through the magazine, a mandrel 26 being arranged in a stationary manner in relation to the magazine, for example approximately at the center of the magazine 23. The lowest supporting plate 1 of the view of FIG. 8 has been pushed over the mandrel 26, which constitutes a guide, and then rests on the sleeve 25, the latter having a greater diameter in the area of the bearing surface than the diameter of the hole 2. Thus, as a result of a movement of the sleeve 25 in an advancing direction 27, in each case the uppermost supporting plate 1 can be removed automatically or using an auxiliary apparatus, for further processing. With respect to the automatic detection of an emptied magazine 23 and the removal of the empty magazine 23, as well as the insertion of a filled magazine 23, these processes can be carried out either manually or in an automated manner. If the supporting plates 1 stacked one above another are adequately fixed in position by means of the webs 24, penetration of the mandrel 26 through the individual holes 2 in the supporting plates 1 can be dispensed with, so that instead of the movable sleeve 25 and the guiding action by the mandrel 26, implemented for example by a T-shaped design of the sleeve 25, only the lowest supporting plate 1 and thus the further supporting plates 1 stacked above it are lifted. However, the mandrel 26, in particular one with a cone 28 provided at the upper end, has the advantage that when the magazine 23 is being filled, good and reliable insertion of the supporting plates 1 into the magazine 23 is provided.

FIG. 9 shows the underside 19 of the supporting plate 1 again, it being possible to see again the fastening holes 21, in addition to the hole 2 for leading the throttle-valve shaft through. It is also shown that the studs 20 are distributed over an area which permits the supporting plates 1 to be stacked one above another in an essentially plane-parallel manner in the magazine 23, the studs of one supporting plate not resting on coated or otherwise sensitive areas of the supporting plate located underneath. For this purpose, at least three studs are arranged in the form of a tripod above the surface of the supporting plate 1, it also being possible to use more than three studs, as is shown in FIG. 9 using the example of four studs 20. It should be pointed out once more that the studs have the particular advantage that by this means, on the one hand, point contact with the supporting plate 1 located beneath is ensured, while during the remaining handling of the supporting plates 1, possible sticking to other parts, which is always possible, is effectively avoided by the rounded studs 20. Moreover, however, depending on the application, studs 20 of other shapes (for example elongate studs or studs with a square or rectangular cross section) are also conceivable.

FIG. 10 shows, dashed, the supporting plate 1, which rests with its underside 19 on at least one bearing surface. Three bearing surfaces 29 to 31 of different shapes, on which the supporting plate 1 rests, are shown in FIG. 10. The arrangement of the studs 20 (and, if appropriate, further spacers) is chosen over the area of the underside 19 of the supporting plate 1 in such a way that these studs do not come to rest in the area of the bearing surfaces 29 to 31, so that after the underside 19 of the supporting plate 1 has been placed onto the bearing surfaces 29 to 31, the studs 20 do not come into contact with the area from which the bearing surfaces 29 to 31 project, so that the studs 20, when installed, "float in the air" and in this case are no longer effective. The fastening of the supporting plate 1 to the bearing surfaces 29 to 31 can be effected by adhesive bonding, while it can of course also be carried out by screw fixing (as already described in relation to FIG. 1). The bearing surfaces 29 to 31 illustrated in FIG. 10 are a constituent part of a housing (or of a cover) of a throttle-valve connecting piece, a throttle arranged on a throttle-valve shaft being mounted so that it can rotate in this throttle-valve connecting piece, the throttle-valve shaft projecting through the hole 2 in the supporting plate 1. The bearing surfaces 29 to 31, whose configuration does not dictate the shapes shown in FIG. 10, project from the housing of the throttle-valve connecting piece and are brought into a plane-parallel form, for example, following the casting of the housing, by appropriate machining (for example milling), so that a number of plane-parallel surfaces, at least one, is therefore available as a support for the supporting plate 1. The essential factor is that the height of the bearing surfaces 29 to 31 is at least slightly greater than the height of the studs 20, so that the latter do not come to rest on the area located underneath.

Figure 11:
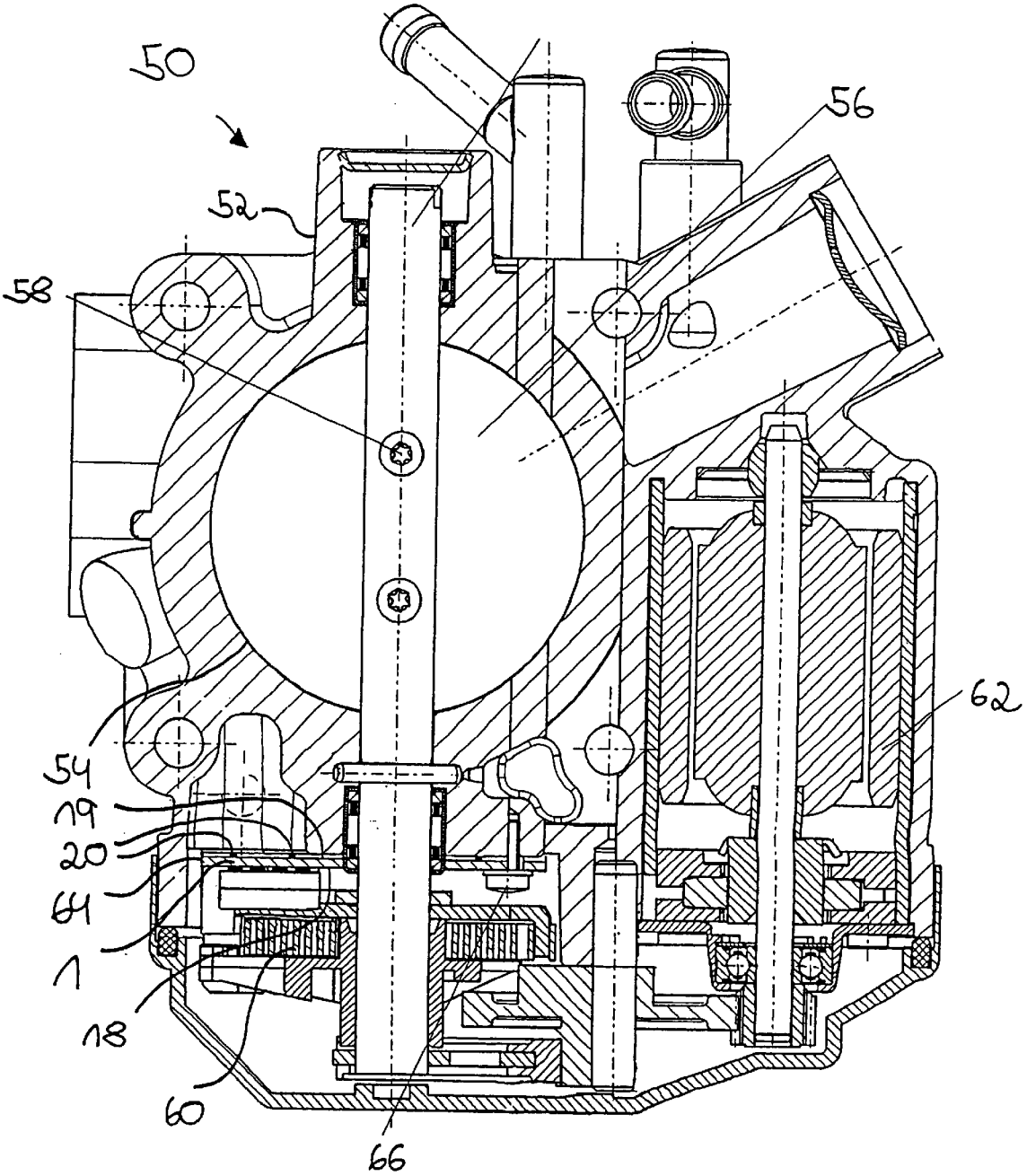
FIG. 11 shows a plan view of a throttle valve.

FIG. 11 shows a throttle valve 50 for controlling the output of an internal combustion engine by regulating the amount of air applied to the internal combustion engine. For this the throttle valve comprises a housing 52, which can be made from aluminum or alternatively from plastics. The housing 52 comprises an opening 54, which is designed for bringing the air to the internal combustion engine. For adjusting the amount of air for the internal combustion engine, there is a throttle 56 arranged with screws 58 on a throttle valve shaft 11 in the opening 54. The throttle valve shaft 11 and hence the throttle 56 can be driven via a gear 60 with an electric motor 62. To record the actual position of the throttle valve shaft 11 at any time, the throttle valve 50 comprises a potentiometer 64 with a supporting plate 1, which is fastened to the housing 52 by screws 66. The supporting plate 1 comprises an upper side 18 and an underside 19. On the underside 19 there are spacers or studs 20, which define a precise distance between the underside 19 of the supporting plate 1 and the housing 52 of the throttle valve, so that simple and precise installation is possible without further adjustment tools or apparatus being necessary.

I claim:

1. Magazine (23) configured for holding supporting plates to be employed in the construction of potentiometers of which an individual potentiometer has a supporting plate (1), wherein, in the individual potentiometer the supporting plate (1) is to be mounted on a substrate, wherein the supporting plate (1) comprises a printed circuit board with an upper side (18) on which are located resistance tracks (3, 4) formed thereon, wiper tracks (5, 6) and conductor tracks (7) of the potentiometer, and an underside (19) with spacers projecting therefrom;

wherein a number of the potentiometer supporting plates are stacked one above another for further processing.

2. Magazine (23) as claimed in claim 1, wherein the magazine (23) has webs (24) for fixing the potentiometer supporting plates stacked one above another in position.

3. Magazine (23) as claimed in claim 1, wherein a mandrel (26) is provided, which accommodates and moves the potentiometer supporting plates stacked one above another in a stacking direction, so that said potentiometer supporting plates can be removed from the magazine (23) one after another for further processing.

4. A magazine according to claim 1, wherein the supporting plate has a planar configuration, and the spacers extend from the supporting plate in a direction perpendicular to a plane of the plate.

* * * * *